US010235855B2

(12) United States Patent
Li

(10) Patent No.: US 10,235,855 B2
(45) Date of Patent: Mar. 19, 2019

(54) ACOUSTO-MAGNETIC ANTI-THEFT LABEL WITH EMBOSSED FEATURES ON THE UPPER SURFACE AND METHOD OF MANUFACTURE

(71) Applicant: Ningbo Signatronic Technologies, Ltd., Ningbo (CN)

(72) Inventor: Lin Li, Ningbo (CN)

(73) Assignee: Ningbo Signatronic Technologies, Ltd., Ningbo, BeiLun (CN)

( * ) Notice: Subject to any disclaimer, the term of this patent is extended or adjusted under 35 U.S.C. 154(b) by 0 days.

(21) Appl. No.: 15/284,063

(22) Filed: Oct. 3, 2016

(65) Prior Publication Data

US 2017/0103630 A1 Apr. 13, 2017

(30) Foreign Application Priority Data

Oct. 8, 2015 (CN) ..... 2015 1 0645807

(51) Int. Cl.
*G08B 13/24* (2006.01)

(52) U.S. Cl.
CPC ..... *G08B 13/2434* (2013.01); *G08B 13/244* (2013.01); *G08B 13/2408* (2013.01); *G08B 13/2422* (2013.01)

(58) Field of Classification Search
CPC ..... G08B 13/2434; G08B 13/2408; G08B 13/2437; G08B 13/2442; G08B 13/2417; G08B 13/248; G08B 13/00
See application file for complete search history.

(56) References Cited

U.S. PATENT DOCUMENTS

| | | | | |
|---|---|---|---|---|
| 4,510,489 | A | 4/1985 | Anderson et al. | |
| 5,716,460 | A * | 2/1998 | Manning | C21D 8/1233 148/120 |
| 6,359,563 | B1 * | 3/2002 | Herzer | G08B 13/2408 148/108 |
| 9,640,852 | B2 * | 5/2017 | Chandramowle | G08B 13/2434 |
| 2008/0084308 | A1 | 4/2008 | Roth | |
| 2009/0322528 | A1 | 12/2009 | Li | |
| 2014/0218197 | A1 | 8/2014 | Li | |

FOREIGN PATENT DOCUMENTS

| | | | |
|---|---|---|---|
| EP | 2023304 | A1 | 2/2009 |
| WO | 2009091544 | A1 | 7/2009 |

* cited by examiner

*Primary Examiner* — Kabir A Timory
(74) *Attorney, Agent, or Firm* — Miller Law Group, PLLC

(57) ABSTRACT

An anti-theft AM label is formed with a housing that includes concave and/or convex patterns and wordings on the upper surface thereof. The concave and/or convex patterns and wordings provide a different appearance for anti-theft AM labels that can deter shoplifters from finding and removing the labels from the goods the labels are protecting. The concave and/or convex patterns can be the logo of the store in which the labels are used. The upper surface of the housing can be formed with a cold forming process or a hot forming process. The shape of the housing can be varied between square, rectangular, circular, sector and oval configurations, as desired by the customer. The depth of the patterns and words relative to a flat portion of the upper surface of the housing is in the range of 0.05-1.0 mm or, more preferably, in the range of 0.2-1.0 mm.

18 Claims, 3 Drawing Sheets

Fig. 5
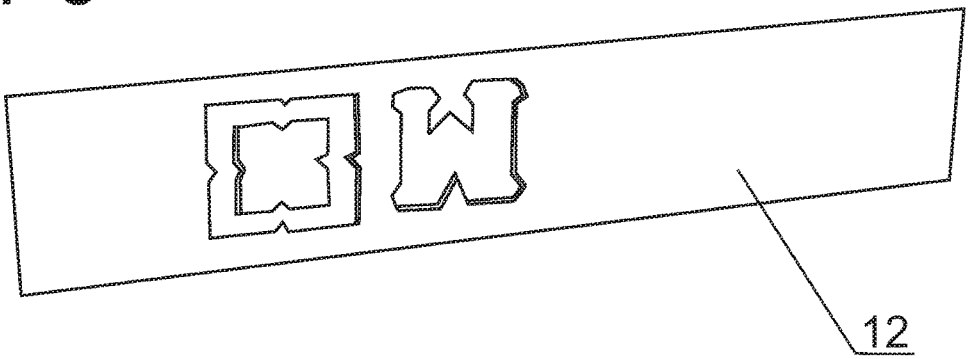
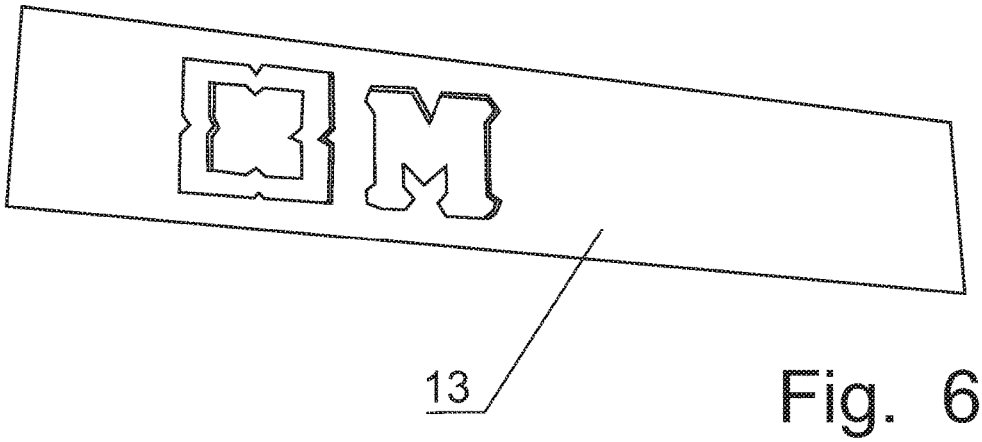
Fig. 6
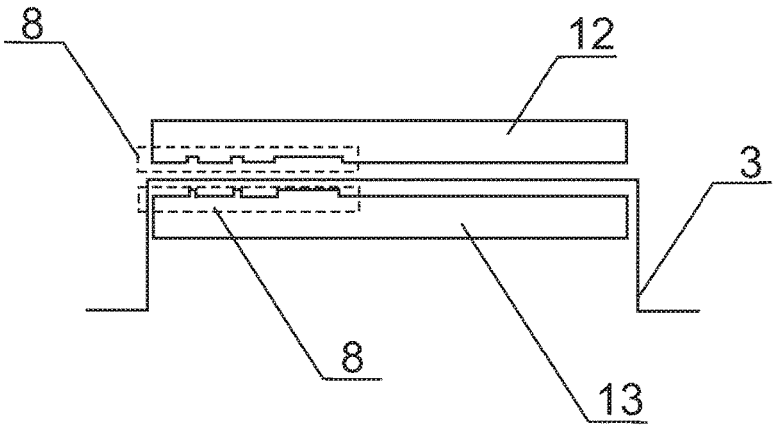
Fig. 7

ACOUSTO-MAGNETIC ANTI-THEFT LABEL WITH EMBOSSED FEATURES ON THE UPPER SURFACE AND METHOD OF MANUFACTURE

FIELD OF THE INVENTION

The present invention relates to a device used in electronic article surveillance (EAS) and its methods of making. More specifically, the present invention relates to an acousto-magnetic (AM) anti-theft label made with concave and/or convex patterns or wordings on the upper surface of the housing, and the method of manufacturing same.

BACKGROUND OF THE INVENTION

Acousto-magnetic (AM) technology has been used for electronic article surveillance anti-theft devices. The original concept for an acousto-magnetic label is disclosed in U.S. Pat. No. 4,510,489, granted on Apr. 9, 1985, to Philip M. Anderson, et al, which teaches that certain amorphous alloy strips can generate strong resonating signal due to a high magnetic-elastic exchange coupling factor. Such amorphous alloy strips can be utilized through the disclosed Anderson principle by using such materials in a commercial anti-theft system (AM system), such as the anti-theft systems installed in supermarkets, etc. An AM system includes in detection panel, deactivation and deactivation verifier, and an AM label or tags. A widely used AM detection panel is marketed by Sensormatic Electronics Corporation (Sensormatic) under the brand name of Ultramax. The detection panels can emit 58 kHz pulse field, to exciting the active AM labels in the interrogation zone, to emit very strong signal as the result from resonating at 58 kHz. The signal can be detected by the search coils.

Deactivation is carried out by demagnetizing the bias in the anti-theft AM labels, resulting in the resonating frequency being shifted out of the detection window, meanwhile significantly lowering the resonating amplitude. Therefore, deactivated AM labels will not set off the detection systems. There are two types of AM tags, a hard tag and a soft label. The hard tag uses amorphous ribbon as resonators and uses permanent magnets (such as bonded ferrites) as the bias. This hard tag type of AM Tags, such as Supertags I, II, III made by Sensormatic, cannot be deactivated by deactivators and are used repeatedly inside the stores. The hard tag can be detached mechanically from a locking device so that goods being protected by the hard tag can leave the store without setting off the alarm corresponding to the detection system installed at the gates.

The soft label also uses an amorphous alloy as the resonators, but uses "semi-hard" or "soft" magnetic materials as the bias (e.g. the DR labels made by Sensormatic and T3 labels made by Ningbo Signatronic Technologies, Inc.) This type of AM soft tag can be deactivated and re-activated repeatedly. The AM labels on paid goods are typically deactivated by a deactivator, so that goods can leave the store without triggering the detection system at the gates.

Currently, the flat upper surface of the housing on AM labels can be printed for some patterns, which can serve several purposes. For instance, the AM label supplier can print its own brand name or registered trademark on the upper surface to show the AM label is an authentic product for anti-fake function. Sometime the upper surface can be printed with a fake barcode as a decoy, in hopes that shoplifters would regard this fake barcode as a price barcode and not remove the anti-theft label from the product. Sometimes, retailers intentionally print some anti-theft sign on the upper surface to act as open warning in hopes that the warning can deter shoplifters.

Also, certain retailers request that their logo be printed on the anti-theft labels so that when a dispute arises to determine whether a detector system alarm is caused by the AM labels for that particular retailer store or from a failed deactivated AM label from another store.

However, the shape and appearance of AM labels have not been changed much since its invention in 1982. Currently billions of AM labels, with the familiar supplier logo, and a familiar but monotonous rectangular shape, are used worldwide annually and are well recognizable by consumers. The problem is that shoplifters are also very familiar with such shape, barcode and patterns of these anti-theft labels, which makes it easy for shoplifters to identify these AM labels and try to remove the AM labels from the goods they are attempting to shoplift. As the result, certain retailers are not satisfied with the conventional concealment tactics for the AM labels and have tried new concealment methods for their AM labels, such as hiding the AM label into a commercially used hangtag which is printed with patterns or wordings, or using a plastic overlay with patterns or wordings to cover the AM labels.

However, such double processes cause higher process costs. Furthermore, some AM labels can be partially damaged during such concealment methods, resulting in a lower detection rate. In addition, such solutions do not end up as nice looking products. Consequently, certain retailers would like to have a direct AM label which has a better concealment function, but does not need such double processes. Some retailers would also like a new concealment method that is different from conventional monotonous shaped AM labels to enhance the anti-theft effect. Also, certain retailers would like their logo shown on their goods as well as the AM labels to protect these goods.

It is known in the art to emboss concave and/or convex patterns or wordings on injection molded products. For instance, embossed patterns or wordings are commonly found on hard AM tags with wide applications in the stores and with customers' acceptance. However, AM soft labels are made with thin (about 0.3 mm) PS/PE laminated) plastic film to form the resonator housing by hot forming manufacturing techniques. The upper surface of such a housing is so thin, it is not easy to make fine and nice concave and/or convex patterns or wordings on it. Consequently, there is no report on how to make 3-D patterns or wordings on the upper surface of the housing of AM soft labels, which has prevented the further development on conceal technologies for AM labels.

Accordingly, it would be desirable to provide a soft AM label housing and a method of manufacturing that would provide a quality embossed pattern or word in the upper surface of the housing.

SUMMARY OF THE INVENTION

It is an object of this invention to overcome the disadvantages of the prior art by providing AM soft labels formed with concave and/or convex patterns and wordings on the upper surface of the housing thereof.

It is another object of this invention to provide a method to make the aforementioned AM soft labels with concave and/or convex patterns and wordings on its upper surface.

It is a feature of this invention that the anti-theft AM label is formed with concave and/or convex patterns and wordings on the upper surface, including in label housing, resonator(s)

and bias. The housing has a cover which is made of seal film. The housing and cover formed a resonating cavity. The resonator(s) is (are) placed inside the cavity. The housing has concave and/or convex patterns and wordings on its upper surface. At least one resonator and at least one bias are needed.

It is another feature of this invention that the aforementioned upper surface has concave or convex patterns and wordings.

It is an advantage of this invention that the concave or convex patterns and wordings on the upper surface of the housing, compared to a housing without concave or convex upper surface, has a relative height difference in the range of 0.05-1.0 mm, as more preferred, the height difference is in the range of 0.1-1.0 mm, further preferred, the height difference is in the range of 0.2-1.0 mm.

It is another advantage of this invention that the upper surface area is in the range of 2.0-30.0 square mm.

It is still another feature of this invention that the housing can be formed in rectangular or circular configurations.

It is still another object of this invention to provide a method to make the aforementioned anti-theft AM soft labels, using cold work to form concave or convex patterns and wordings on its upper surface.

It is yet another feature of this invention that the method of manufacturing includes steps to cold form the flat upper surface on pre-formed housing, using cavity and core tools.

It is yet another advantage of this invention that the method of using the aforementioned cold work tools to form the AM label with concave or convex patterns and wordings on its upper surface would have height difference in the range of 0.05-1.0 mm relative to flat upper surface part. Further preferred, the height difference is in the range of 0.1-0.8 mm, and still further preferred is height difference is in the range of 0.05-0.8 mm.

It is yet another object of this invention to provide a method of making the aforementioned anti-theft AM soft labels, using hot work, utilizing modified original flat tools into cavity and core tools, to form concave or convex patterns and wordings on its upper surface.

It is a further feature of this invention that the method of manufacturing includes steps to hot press to form the housing, having the flat upper surface with concave or convex patterns and wordings on it.

It is an object of this invention to make anti-theft AM soft labels that have a new appearance so as to be different from conventional AM label appearance, so that potential shoplifters could not easily recognize such concealed AM labels.

It is another object of this invention to form the aforementioned anti-theft AM labels by forming the labels with 5 cm×5 cm square shape, or round, sector, oval shape, footprint with the projection (footprint) having area=2.5–30.0 square cm, meanwhile the upper surface has concave or convex patterns and wordings on it, which will distinguish the AM label from conventional rectangular AM label with about 12×45 mm projected area.

It is a further advantage of this invention that the anti-theft AM labels do not require a double process to form the label with an appearance and marking that differs from conventional monotonous AM labels with new conceal methods.

It is still a further advantage of this invention that the improved AM label can enhance the anti-theft effectiveness and also show store logos both on goods as well as on the AM labels that protect these goods.

It is a further object of this invention to provide an AM anti-theft security tag manufactured with a housing have an upper surface that includes concave and/or convex patterns or word to provide a different appearance for AM labels that are durable in construction, lower cost of manufacture, and simple and effective in use.

These and other objects, features and advantages are accomplished according to the instant invention by providing an anti-theft AM label formed with a housing that includes concave and/or convex patterns and wordings on the upper surface thereof. The concave and/or convex patterns and wordings provide a different appearance for anti-theft AM labels that can deter shoplifters from finding and removing the labels from the goods the labels are protecting. The concave and/or convex patterns can be the logo of the store in which the labels are used. The upper surface of the housing can be formed with a cold forming process or a hot forming process. The shape of the housing can be varied between square, rectangular, circular, sector and oval configurations, as desired by the customer. The depth of the patterns and words relative to a flat portion of the upper surface of the housing is in the range of 0.05-1.0 mm or, more preferably, in the range of 0.2-1.0 mm.

BRIEF DESCRIPTION OF THE DRAWINGS

The advantages of this invention will be apparent upon consideration of the following detailed disclosure of the invention, especially when taken in conjunction with the accompanying drawings wherein:

FIG. 5 is a schematic drawing of a female tool for forming the concave and/or convex structure on the upper surface of the label housing;

FIG. 6 is a schematic drawings of a male tool cooperable with the female tool to form the concave and/or convex structure on the upper surface of the label housing; and FIG. 7 is a schematic drawing representing the process of the placement of the concave and/or convex structure into the upper surface of the anti-theft label.

DETAILED DESCRIPTION OF THE PREFERRED EMBODIMENT

Figure 1:
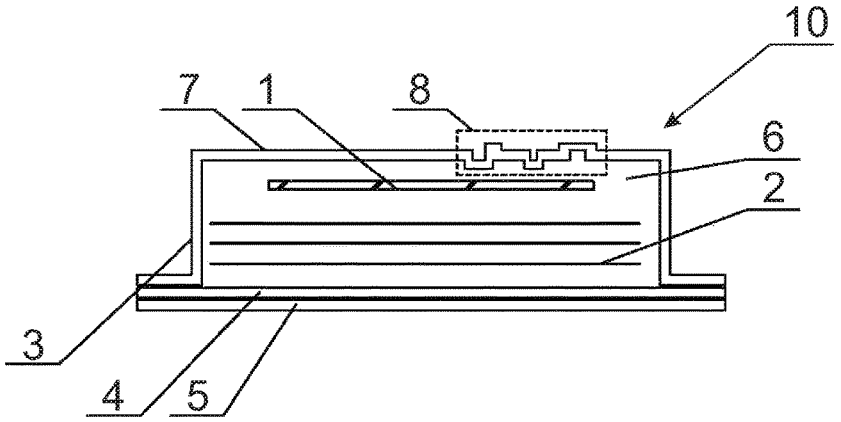
FIG. 1 is schematic drawing for the structure of this invented label.

Referring now to the drawing, an acousto-magnetic label incorporating the principles of the instant invention can best be seen. The technique used in following embodiments, unless specifically stated, all are conventional technique by the arts in the field. All instrument and equipment, unless specifically stated, are can all be obtained from public knowledge by the art in the field.

Embodiment 1

As shown in FIG. 1, an anti-theft AM label 10 with concave and/or convex patterns or words on its upper surface can include an elongated housing 3, a resonator 2 and a bias 1. The housing has a cover made with double tape 5 and seal film 4. The housing and cover form a closed a resonating cavity 6, with the aforementioned resonators 2 and bias 1 being placed inside the resonating cavity 6. In this embodiment, the anti-theft label 10 is formed with three resonators and one bias.

The housing 3 has an upper surface 7 formed with concave and/or convex structure 8. The concave and/or convex structure 8 is on the upper surface 7 for an identification function. The concave height and convex height of the aforementioned concave and/or convex structure 8 are 0.05 mm in relation to the flat portion of the upper surface 7.

This anti-theft AM soft label 10, as depicted in FIG. 1, can be manufactured by using cold work to form concave or convex patterns and wordings on its upper surface 7. This method includes steps to cold form the flat upper surface on pre-formed housing, using cavity and core tools.

Embodiment 2

An AM anti-theft label 10 with concave and/or convex patterns or words on its upper surface 7, including an elongated housing 3, a resonator 2 and a bias 1. The housing 3 has a cover made with double tape 5 and seal film 4. The housing 3 and cover form a closed resonating cavity 6 with the resonators 2 and bias 1 being placed inside the resonating cavity 6. This embodiment can also be formed with three resonators 2 and one bias 1.

The housing 3 has an upper surface 7 with concave and/or convex structure 8. The concave and/or convex structure 8 is on the upper surface 7 is for an identification function. The concave height and convex height of the aforementioned concave and/or convex structure 8 are 0.1 mm in relative to flat surface portion of the upper surface 7.

Embodiment 3

Figure 2:
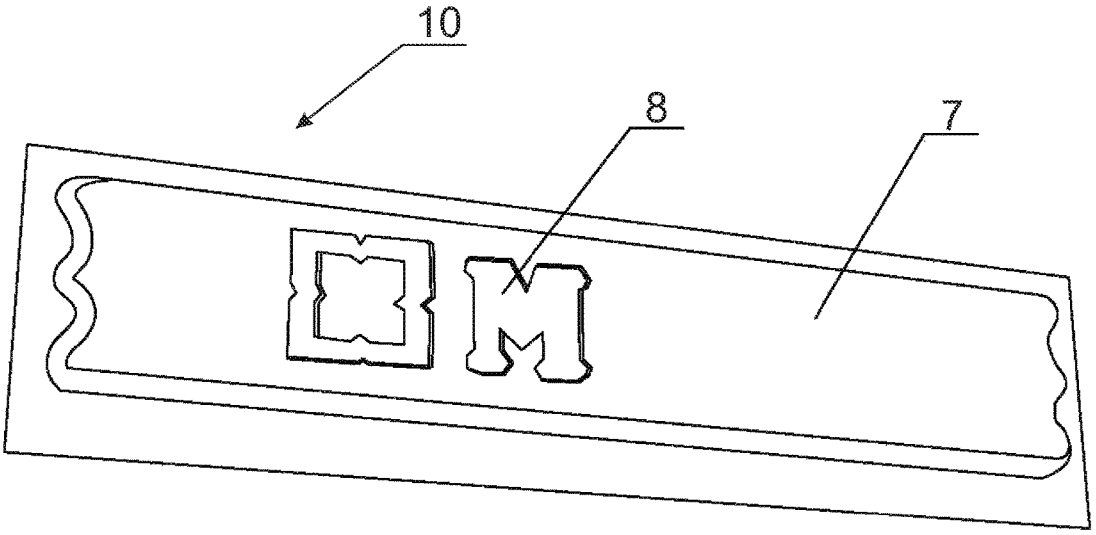
FIG. 2 is schematic drawing for the 3-D structure of this invented label.

As shown in FIG. 2, an anti-theft AM label 10 with concave and/or convex patterns or words on its upper surface 7 includes an elongated housing 3, resonator 2 and bias 1. The housing 3 has a cover made with double tape 5 and seal film 4. The housing 3 and cover form a closed resonating cavity 6 with the aforementioned resonators and bias being placed inside the resonating cavity 6. This embodiment can be formed with three resonators 3 and one bias 1.

The housing 3 has an upper surface 7 with a concave and/or convex structure 8. The concave and/or convex structure 8 is formed on the upper surface 7 for identification purposes. The concave height and convex height of the aforementioned concave and/or convex structure 8 are 0.2 mm in relative to flat portion of the upper surface 7. The area of the upper surface 7 of this label 10 is 2.0 square cm with the projected footprint of the label 10 being 3.1 square cm.

This anti-theft AM soft label 10 can be manufactured using hot work, having modified the original flat tools into cavity and core tools, to form the concave or convex patterns and wordings on the upper surface 7. This method of manufacturing includes steps to hot press to form the housing, having the flat upper surface formed with concave or convex patterns and wordings on it. One of the goals of this invention is to make a label 10 with a new appearance so as to be different from the appearance of conventional AM label 10*s*, so that potential shoplifters would not easily recognize such AM labels when concealed on the product being protected.

Embodiment 4

Figure 3:
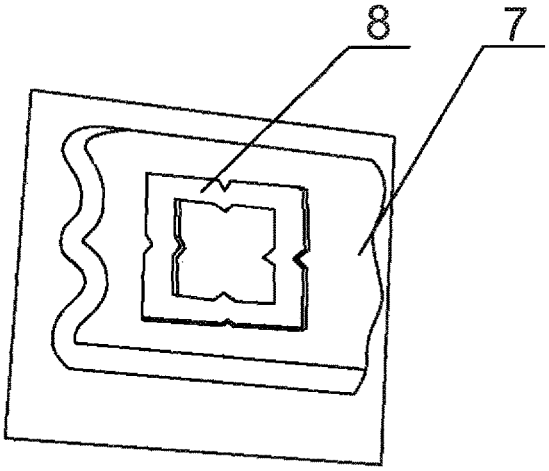
FIG. 3 is schematic drawing for the 3-D structure of the label in embodiment 4.

As shown in FIG. 3, an anti-theft AM label 10 with concave and/or convex patterns or words on its upper surface includes a squared housing 3, a resonator 2 and a bias 1. The housing 3 has a cover made with double tape 5 and seal film 4. The housing 3 and cover form a closed resonating cavity 6 with the aforementioned resonators 3 and bias 1 being placed inside the resonating cavity 6. This embodiment can also be formed with three resonators 3 and one bias 1.

The housing 3 has an upper surface 7 with concave and/or convex structure 8. The concave and/or convex structure 8 is formed on the upper surface 7 for the function of identification. The concave height and convex height of the aforementioned concave and/or convex structure 8 are 0.8 mm in relation to flat portion of the upper surface 7. The area of the upper surface of the label 10 is 3.5 square cm with the projected footprint of the label 10 being 25.0 square cm.

Embodiment 5

Figure 4:
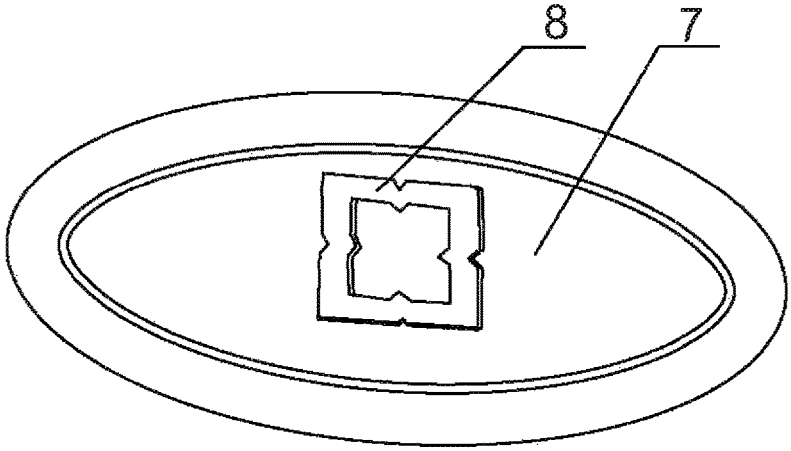
FIG. 4 is schematic drawing for the 3-D structure of the label in embodiment 4.

As shown in FIG. 4, an anti-theft AM label 10 is formed with concave and/or convex patterns or words on its upper surface, including an oval shaped housing 3, a resonator 2 and a bias 1. The housing 3 has a cover made with double tape 5 and seal film 4. The housing 3 and cover form a closed resonating cavity 6, with the aforementioned resonators 2 and bias 1 being placed inside the resonating cavity 6. This label 10 can be formed with three resonators 2 and one bias 1.

The housing 3 has an upper surface 7 with concave and/or convex structure 8 formed on the upper surface 7 for the purpose of providing an identification function. The concave height and convex height of the aforementioned concave and/or convex structure 8 are 1.0 mm in relation to the flat portion of the upper surface 7. The projected footprint of the label 10 is 15.8 square cm.

Manufacturing Process:

The embossed concave and/or convex structure 8 forming patterns and/or words into the structure of the upper surface 7 of the housing 3 can be accomplished through cold works or through hot works.

Cold works or cold forming means that the plastic film is pressed between a set of cavity and core tools to "coin" or "press" the pattern or wording into the upper surface of the plastic film forming the housing 3 at room temperature without utilizing any heating process applied to the plastic film. When the embossing is formed through cold works, the housing 3 is first formed with a flat upper surface by hot forming (either non-vacuum or vacuum) the plastic film and allowed to cool to room temperature (about 25 degrees centigrade). After cooling, the housing 3 is placed into a set of cavity core tools 12, 13, depicted schematically in FIGS. 5-7, and the tools 12, 13 are pressed together with the upper surface 7 of the housing therebetween. With the male tool 13 pressing the plastic of the housing 3 into the female tool 12, the embossed pattern and/or words are produced. Thus, the cold works process of embossing the pattern and/or words into the upper surface 7 of each housing 3 is a two-step process in which the housing is formed in the first step and the cold works embossing is accomplished in the second step. One skilled in the art will recognize that the housings 3 are formed in a sheet form with many housings 3 formed on a single sheet of plastic material. Accordingly, the cavity core tools 12, 13 would preferably be formed to process an entire sheet of housings 3 simultaneously.

Hot works or hot forming means that the plastic film is pressed between a set of cavity and core tools to form the embossed upper surface while the resonating housing 3 is being formed. In this hot works process, the plastic film is pre-warmed and then pressed by a set of cavity and core tools 12, 13, which have a temperature of approximately 80-120 C (e.g. at 95 C or 115 C depending on forming speed, tool sizes, and holding mechanism, etc.) and released at a "hot" state, resulting in an embossed upper surface, meanwhile the resonating house is made at the same time, too. Thus, in the hot works process, only a single step is required to produce the housings 3 with the concave and/or convex structure 8 formed therein. The sheet of embossed housings 3 is then allowed to cool for the placement of the resonators 2 and the bias 1 into the resonating cavity 6 and then sealed with the seal film 4 and the double tape 5.

One skilled in the art will recognize that forming the concave and/or convex structure 8 through cold works can subject the upper surface 7 to cracking during the formation of the concave and/or convex structure 8. Furthermore, the cold works process is less flexible for use in fine details if desired by the customer. Accordingly, the hot works process is preferable in the formation of labels 10 having concave and/or convex structure 8 forming patterns and/or words into the upper surface 7 of the housing 3.

The above-described embodiments are preferred solutions for the instant invention, which is not intended to limit this invention in any form. One skilled in the art will recognize that other alternative and modified solutions can be provided within the claimed scope of the invention.

Having thus described the invention, what is claimed is:

1. An acousto-magnetic (AM) anti-theft label comprising:

a housing defining a resonating cavity having sidewalls formed as a smooth linear side surfaces and an upper surface formed with a concave and/or convex structure that forms a three-dimensional pattern into said upper surface, said three-dimensional pattern incorporating letters, numbers and/or identification symbols to provide an identification function with respect to the anti-theft label, said three-dimensional pattern being located on said upper surface spaced from said side surfaces without engaging any portion of said side walls, said three-dimensional pattern having a footprint located within a central portion of said upper surface wherein said footprint has an area smaller than a corresponding upper surface area of the housing, said three-dimensional pattern forming identification images and/or words into said upper surface;

a resonator positioned within said resonating cavity;

a bias positioned nearby the resonator; and a cover with a seal film secured to said housing to close said resonating cavity with said resonator and said bias being positioned proximate to one another.

2. The acousto-magnetic anti-theft label of claim 1 wherein said concave and/or convex structure formed on said upper surface has a height difference in a range of 0.05-1.0 mm in relation to a flat portion of said upper surface adjacent said concave and/or convex structure.

3. The acousto-magnetic anti-theft label of claim 2 wherein said height difference of said concave and/or convex structure formed on said upper surface has a range of 0.1-1.0 mm.

4. The acousto-magnetic anti-theft label of claim 3 wherein said height difference of said concave and/or convex structure formed on said upper surface has a range of 0.2-1.0 mm.

5. The acousto-magnetic anti-theft label of claim 1 wherein said upper surface has an area in a range of 2.0-30.0 square cm.

6. The acousto-magnetic anti-theft label of claim 5 wherein the housing has a configuration-shaped as a square or a circle.

7. The acousto-magnetic anti-theft label of claim 1 wherein said concave and/or convex structure is formed into said upper surface using a cold works forming process to form said concave and/or convex structure after the resonating cavity has been formed in said housing.

8. The acousto-magnetic anti-theft label of claim 7 wherein said concave and/or convex structure is formed with cavity core tools used for the cold forming process and having concave and/or convex structure with height difference on flat surface in the range of 0.05-1.0 mm.

9. The acousto-magnetic anti-theft label of claim 1 wherein said three dimensional pattern is formed into said upper surface simultaneously with formation of the resonating cavity using a hot works forming process.

10. The acousto-magnetic anti-theft label of claim 1 wherein said bias and said-resonator are positioned within the resonating cavity between the cover and the upper surface.

11. A method of manufacturing an acousto-magnetic (AM) anti-theft label comprising the steps of:

forming a housing to define a resonating cavity, said housing having smooth linear side walls and an upper surface having a surface area dimension defined by a perimeter of said upper surface corresponding to said side walls;

creating a concave and/or convex structure forming a three-dimensional pattern into said upper surface, said three-dimensional pattern covering an area less than said surface area of said upper surface and being spaced from, without engaging any portion of, said side walls along said upper surface perimeter, said three-dimensional pattern including letters, numbers and/or identification symbols to define an identification meaning with respect to the user and/or manufacturer of the anti-theft label, said three-dimensional pattern having a footprint located within a central portion of said upper surface wherein said footprint has an area smaller than a corresponding upper surface area of the housing, said three-dimensional pattern forming identification images and/or words into said upper surface;

inserting a resonator into said resonating cavity;

providing a bias proximate to said resonator; and placing a cover onto said housing to close said resonating cavity with said resonator enclosed within said resonating cavity.

12. The method of claim 11 wherein said creating step creates concave and/or convex structure formed on said upper surface which has a height difference in a range of 0.05-1.0 mm in relation to a flat portion of said upper surface.

13. The method of claim 11 wherein said creating step creates concave and/or convex structure formed on said upper surface which has a height difference in a range of 0.1-1.0 mm in relation to a flat portion of said upper surface.

14. The method of claim 11 wherein said creating step creates concave and/or convex structure formed on said upper surface which has a height difference in a range of 0.2-1.0 mm relative to a flat portion of said upper surface.

15. The method of claim 11 wherein said housing is formed with a configuration shaped as a square or a circle.

16. The method of claim 11 wherein said creating step is accomplished by using a cold works forming process to form said concave and/or convex structure.

17. The method of claim 11 wherein said forming step and said creating step is accomplished simultaneously by using a hot works forming process.

18. An acousto-magnetic (AM) anti-theft label comprising:

a housing defining a resonating cavity having sidewalls formed as a smooth linear side surfaces and an upper surface having a surface area dimension defined by a perimeter formed by said side surfaces;

a three-dimensional pattern formed by concave and/or convex structure formed into said upper surface by utilizing a cold works process, said three-dimensional pattern covering an area less than said surface area of said upper surface and spaced from said side surfaces at the perimeter of said upper surface without engaging any portion of said sidewalls and including letters, numbers and/or identification symbols to provide an identification meaning relating to said anti-theft label, said three-dimensional pattern having a footprint located within a central portion of said upper surface wherein said footprint has an area smaller than a corresponding upper surface area of the housing, said three-dimensional pattern forming identification images and/or words into said upper surface;

a resonator positioned within said resonating cavity;

a bias positioned nearby the resonator; and a cover with a seal film secured to said housing to close said resonating cavity with said resonator and said bias being positioned proximate to one another.

* * * * *